US007690479B2

(12) United States Patent
Tanaka et al.

(10) Patent No.: US 7,690,479 B2
(45) Date of Patent: Apr. 6, 2010

(54) SILENCER

(75) Inventors: Hirotoshi Tanaka, Aichi-ken (JP); Masayuki Yokoi, Nagoya (JP); Fumihiko Mizuno, Inazawa (JP); Hisashi Nishino, Aichi-ken (JP); Tomoki Mabuchi, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 324 days.

(21) Appl. No.: 11/454,988

(22) Filed: Jun. 19, 2006

(65) Prior Publication Data

US 2006/0283661 A1 Dec. 21, 2006

(30) Foreign Application Priority Data

Jun. 20, 2005 (JP) ..... 2005-178744

(51) Int. Cl.
*F01N 1/08* (2006.01)
*F01N 7/00* (2006.01)
*F01N 7/18* (2006.01)

(52) U.S. Cl. ..... 181/268; 181/238; 181/266; 181/269; 181/272; 181/282

(58) Field of Classification Search ..... 181/268, 181/266, 282, 238, 269, 272
See application file for complete search history.

(56) References Cited

U.S. PATENT DOCUMENTS 1,140,693 A * 5/1915 McCulla ..... 181/268
1,280,847 A * 10/1918 Rinehart ..... 165/51
2,193,791 A * 3/1940 Hollerith et al. ..... 181/266
2,573,474 A * 10/1951 Marx ..... 184/47
2,949,165 A * 8/1960 Morrish et al. ..... 181/266
2,958,389 A * 11/1960 Deremer ..... 181/266
2,990,028 A * 6/1961 Powers ..... 181/238
3,087,580 A * 4/1963 Powers et al. ..... 181/282
3,103,256 A * 9/1963 Deremer ..... 181/266
3,289,786 A * 12/1966 Powers ..... 181/266
3,311,189 A * 3/1967 Powers ..... 181/245
3,388,769 A * 6/1968 Martoia ..... 181/238
3,389,764 A * 6/1968 Kelso ..... 181/266
4,153,136 A * 5/1979 Ferralli ..... 181/252
4,637,491 A * 1/1987 Fukuda ..... 181/265
4,846,302 A * 7/1989 Hetherington ..... 181/243
5,025,890 A * 6/1991 Hisashige et al. ..... 181/272
5,801,344 A * 9/1998 Herold ..... 181/272
6,313,971 B1 11/2001 Takagi et al.

(Continued)

FOREIGN PATENT DOCUMENTS

DE 35 06 150 A1 8/1986

(Continued)

*Primary Examiner*—Jeffrey Donels
*Assistant Examiner*—Christina Russell
(74) *Attorney, Agent, or Firm*—Oblon, Spivak, McClelland, Maier & Neustadt, L.L.P.

(57) ABSTRACT

A silencer includes a smaller cylindrical member having a planar portion and a larger cylindrical member arranged to closely contact at least a portion of the outer circumferential surface of the smaller cylindrical member. The larger cylindrical member as seen in a direction orthogonal to its axis provides an oblate cross section having a major axis X and a minor axis Y and the smaller cylindrical member is arranged to have the planar portion traversing the major axis X of the larger cylindrical member.

17 Claims, 4 Drawing Sheets

U.S. PATENT DOCUMENTS

| | | | | |
|---|---|---|---|---|
| 7,377,359 | B2 * | 5/2008 | Hofmann et al. | 181/275 |
| 2005/0224283 | A1 * | 10/2005 | Yokoi et al. | 181/268 |

FOREIGN PATENT DOCUMENTS

| | | | |
|---|---|---|---|
| EP | 0 389 401 | A1 | 9/1990 |
| FR | 1344784 | | 10/1963 |
| GB | 292789 | | 6/1928 |
| JP | 4-87312 | | 7/1992 |
| JP | 2005-16494 | | 1/2005 |

* cited by examiner

SILENCER

This nonprovisional application is based on Japanese Patent Application No. 2005-178744 filed with the Japan Patent Office on Jun. 20, 2005, the entire contents of which are hereby incorporated by reference.

BACKGROUND OF THE INVENTION

1. Field of the Invention

The present invention relates generally to silencers and particularly to silencers used for example for internal combustion engines mounted in automobiles and the like.

2. Description of the Background Art

Vehicles and the like having an internal combustion engine or the like as a power source have a silencer mounted therein for the purpose of reducing noise caused by the internal combustion engine or the like.

The silencer is located under a floor of the vehicle. Accordingly, it is required to be more oblate as seen in cross section in order to ensure a sufficient cabin space and a minimal required spacing from the ground. It has been known, however, that such oblate geometry provides an increased area of a planar geometry of an outer cylinder and hence facilitates membrane vibration, resulting in disadvantageously increased radiating noise.

To address this, Japanese Utility Model Laying-Open No. 04-087312 proposes to provide an oblate outer cylinder with a reinforcement member along the cylinder's minor axis to enhance the cylinder in stiffness to reduce or prevent membrane vibration to reduce radiating noise.

Japanese Patent Laying-Open No. 2005-016494 proposes to provide an outer cylinder with a curving recess and protrusion to enhance the cylinder in stiffness to reduce or prevent the membrane vibration of the cylinder to reduce radiating noise.

The silencer described in Japanese Utility Model Laying No. 04-087312, however, has the reinforcement member and the silencer formed of discrete components, respectively. As such, it is difficult to sufficiently reduce or prevent the membrane vibration of the cylinder.

Furthermore, the silencer described in Japanese Patent Laying-Open No. 2005-016494 that has the outer cylinder provided with a curved geometry has a reduced capacity and hence muffles an insufficient amount of noise.

SUMMARY OF THE INVENTION

The present invention contemplates a silencer that overcomes the disadvantages described above.

In accordance with the present invention a silencer includes a smaller cylindrical member having a planer portion and a larger cylindrical member arranged in close contact with at least a portion of an outer peripheral surface of the smaller cylindrical member. The larger cylindrical member as seen in a direction orthogonal to an axis thereof provides an oblate cross section having a major axis and a minor axis. The smaller cylindrical member is arranged to have the planar portion traversing the major axis of the larger cylindrical member.

Preferably, the smaller cylindrical member may be arranged to have the planar portion substantially parallel to the minor axis of the larger cylindrical member.

Still preferably, more than one the smaller cylindrical member may be provided and arranged such that one thereof and another thereof have planar portions, respectively, in substantially close contact with each other.

In accordance with the present invention the smaller and larger cylindrical members are different in natural frequency. As such, they are less prone to resonance with each other and the membrane vibration of the outer cylinder formed thereof can be reduced or prevented. Furthermore, the smaller and larger cylindrical members cause friction therebetween, which can consume the energy of the membrane vibration and thus reduce or prevent the membrane vibration. As the membrane vibration of the outer cylinder can be reduced or prevented, the radiating noise generated from the outer cylinder can be reduced or prevented.

Furthermore, the planar portion can also serve as a member reinforcing the larger cylindrical member. This can increase the larger cylindrical member in stiffness and thus reduce or prevent its membrane vibration and hence the radiating noise generated from the outer cylinder.

Furthermore the smaller cylindrical members is arranged to have the planar portion substantially overlapping. This can increase the larger cylindrical member in stiffness and thus reduce or prevent its membrane vibration and hence further reduce or prevent the radiating noise generated from the outer cylinder.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A best mode for carrying out the invention will be described with reference to the figures.

First Embodiment

Figure 1:
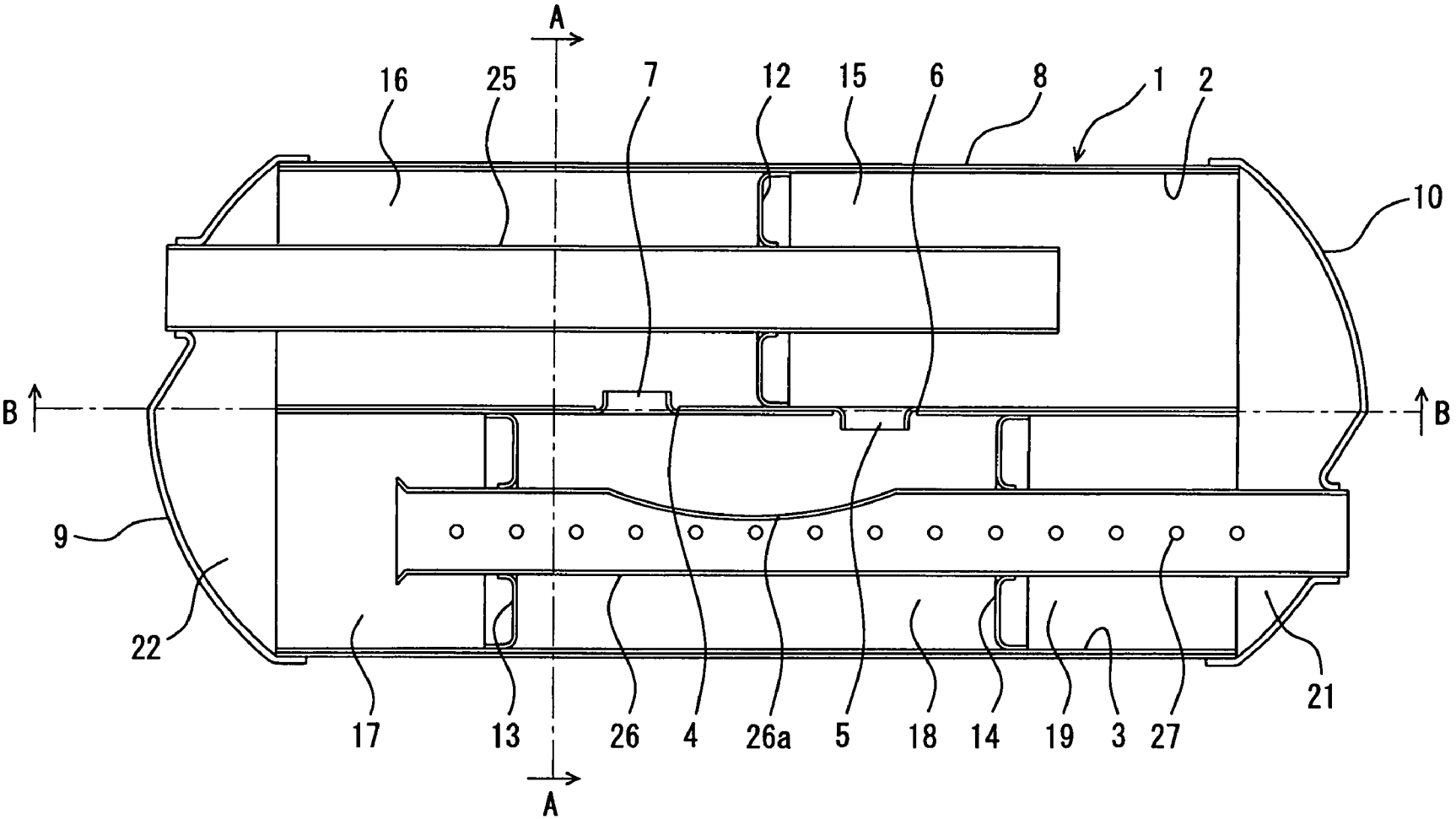
FIG. 1 is an axial cross section of a silencer in a first embodiment of the present invention.
Figure 2:
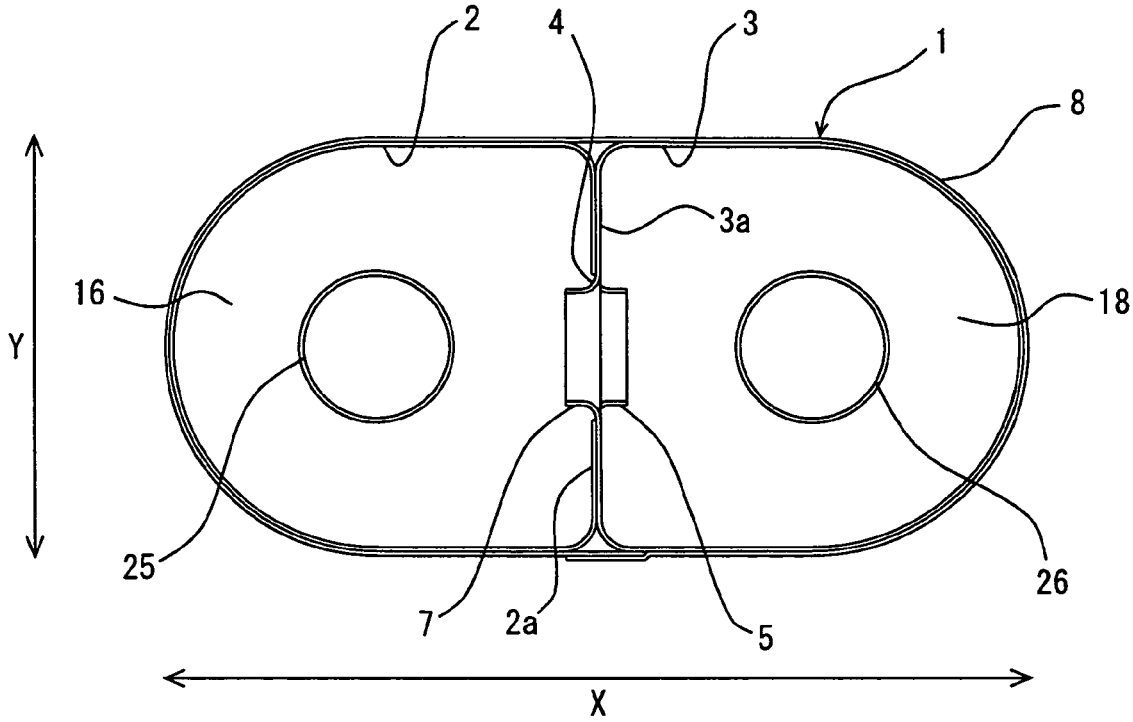
FIGS. 2 and 3 are cross sections taken along lines A-A and B-B, respectively, shown in FIG. 1.
Figure 3:
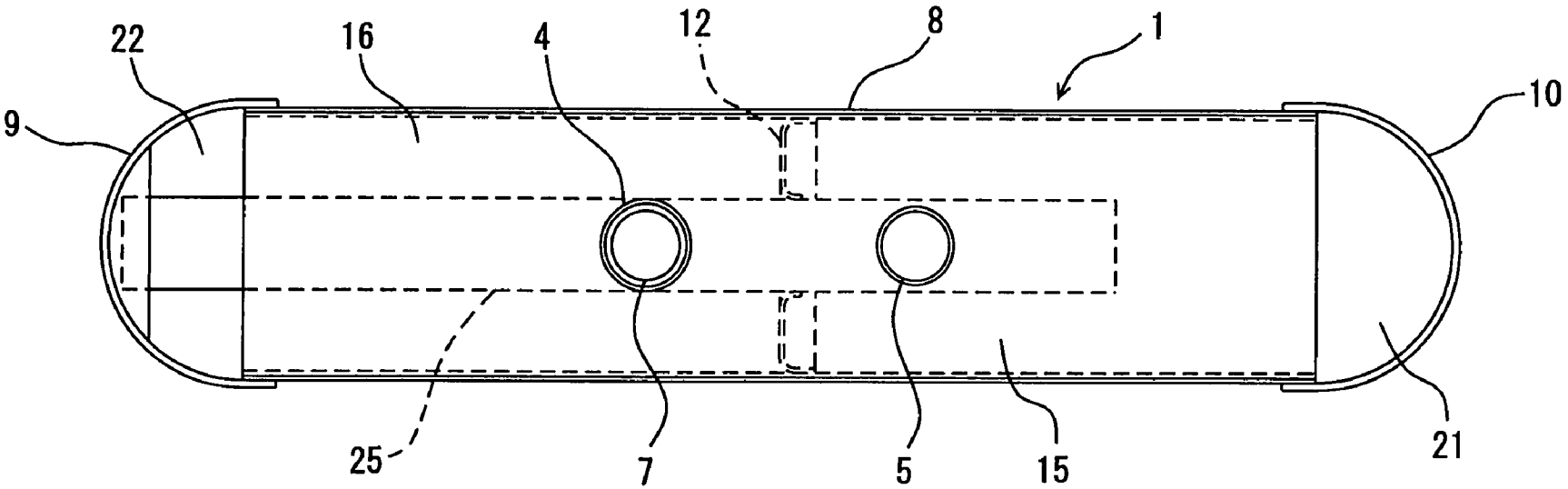

FIGS. 1-3 show a first embodiment of the present invention. FIG. 1 shows a silencer 1 in an axial cross section. Silencer 1 includes a first smaller cylindrical member 2 and a second smaller cylindrical member 3 for a total of two smaller cylindrical members. The first and second smaller cylindrical members 2 and 3 are small in thickness and made of metal, and each have opposite ends open. The first smaller cylindrical member 2, as seen in a cross section orthogonal to its axis, is in the form of the letter D having a planar portion 2*a* at a portion, as shown in FIG. 2. Furthermore, the second smaller cylindrical member 3, as seen in a cross section orthogonal to its axis, is in the form of the letter D having a planar portion 3*a* at a portion, as shown in FIG. 2. The first and second smaller cylindrical members 2 and 3 are formed to be substantially identical in geometry and are arranged opposite to each other to have planar portions 2*a* and 3*a* substantially in close contact with each other.

The first smaller cylindrical member 2 has planar portion 2*a* with a through hole 4 penetrating front and rear sides of planar portion 2*a* and a burred hole 5 protruding outward, i.e., toward the second smaller cylindrical member 3, such that holes 4 and 5 are axially, positionally offset from each other. Similarly, the second smaller cylindrical member 3 has planar portions 3*a* with a through hole 6 formed at a position corresponding to burred hole 5 and a burred hole 7 at a position corresponding to through hole 4. Burred holes 5 and 7 have a radially outer geometry similar to and slightly smaller than the inner circumferential geometry of through holes 4 and 6 and can thus be inserted through through holes 4 and 6.

As burred hole 7 are fitted in through hole 4 and burred hole 5 is fitted in through hole 6, they form communication holes and the first and second smaller cylindrical members 2 and 3 are combined together, and planar portions 2*a* and 3*a* are arranged opposite to each other and also substantially in close contact with each other. The first and second smaller cylindrical members 2 and 3 communicate with each other through through holes 4 and 6 and burred holes 5 and 7.

Note that through holes 4 and 6 and burred holes 5 and 7 are only required to allow the first and second smaller cylindrical members 2 and 3 to communicate with each other, and can be set, as desired, in radially outer geometry, number, area and the like.

The first and second smaller cylindrical members 2 and 3 have an outer circumference surrounded by a larger cylindrical member 8. More specifically, larger cylindrical member 8 is a thin plate member of metal wound around the outer circumference to substantially closely contact the outer circumference and having a circumferential end bonded. In other words, larger cylindrical member 8 is provided to wrap the first and second smaller cylindrical members 2 and 3 together.

Larger cylindrical member 8, as seen in a cross section taken in a direction orthogonal to its axis, is an oblate, oblong circle having a major axis X and a minor axis Y substantially orthogonal to major axis X.

Smaller cylindrical members 2 and 3 have their respective planar portions 2*a* and 3*a* arranged to traverse major axis X of larger cylindrical member 8 and also substantially parallel to minor axis Y. In the first embodiment planar portions 2*a* and 3*a* are substantially orthogonal major axis X.

The first and second smaller cylindrical members 2 and 3 and larger cylindrical member 8 form an outer cylinder, which has opposite ends with end plates 9 and 10 bonded thereto to form a substantially sealed container.

The first smaller cylindrical member 2 has an interior sectioned by a diaphragm 12 to form first and second chambers 15 and 16, and the second smaller cylindrical member 3 has an interior sectioned by diaphragms 13 and 14 to provide third, fourth and fifth chambers 17, 18 and 19.

Note that diaphragms 12, 13 and 14 can be provided at positions, as desired, to achieve a desired amount of noise muffled, desired back pressure, a desired extension ratio, and the like. Similarly, while in the present embodiment three diaphragms, i.e., five chambers are provided, any number of diaphragms, i.e., any number of chambers can be provided.

The first and second chambers 15 and 16 communicate with the fourth chamber 18 via through holes 4 and 6 and burred holes 5 and 7. Furthermore, the first and fifth chambers 15 and 19 communicate with each other through a space 21 formed between the outer cylinder and end plate 10, and the second and third chambers 16 and 17 communicate with each other through a space 22 formed between the outer cylinder and end plate 9.

An inlet pipe 25 connected to an upstream exhaust pipe (not shown) to introduce exhaust gas into silencer 1 is provided in the first smaller cylindrical member 2 to penetrate end plate 10 and diaphragm 12, and has the other (or downstream) end open in the first chamber 15.

An outlet pipe 26 connected to a downstream exhaust pipe (not shown) to guide exhaust gas out of silencer 1 is provided in the second smaller cylindrical member 3 to penetrate end plate 10 and diaphragms 13 and 14, and has the other (or upstream) end open in the third chamber 17. Outlet pipe 26 is provided with a large number of axially arranged interference holes 27 as shown in FIG. 1. Interference holes 27 are only required to be provided in an axial direction of outlet pipe 26; they may be provided in a circumferential direction of outlet pipe 26 uniformly or dispersed at a portion of the circumferential direction.

A portion of outlet pipe 26 that is located in the fourth chamber 18, i.e., a portion 26*a* substantially opposite to through hole 6 and burred hole 7 is formed to have a curvature curving toward the inside of outlet pipe 26. Curvature 26*a* serves as a guide causing exhaust gas flowing from the first chamber 15 through burred hole 5 (through hole 6) into the fourth chamber 18 to flow through burred hole 7 (through hole 4) out into the second chamber 16. This allows the exhaust gas to flow smoothly and can thus contribute to reduced back pressure.

The first embodiment providing the above described structure has the following effect and function: smaller cylindrical members 2 and 3 and larger cylindrical member 8 having geometries, respectively, as described above are different in natural frequency. As such, smaller cylindrical members 2 and 3 and larger cylindrical member 8 are less prone to resonance with each other and the membrane vibration of the outer cylinder is reduced or prevented.

Planar portions 2*a* and 3*a* of smaller cylindrical members 2 and 3 also serve as a member reinforcing larger cylindrical member 8. This can increase larger cylindrical member 8 in stiffness and thus reduce or prevent its membrane vibration. Furthermore in the first embodiment the first and second smaller cylindrical members 2 and 3 are arranged to have their respective planar portions 2 and 3*a* substantially in close contact with each other. Planar portions 2*a* and 3*a* thus provide a two-ply configuration, and larger cylindrical member 8 can be enhanced in stiffness and its membrane vibration reduced or prevented.

Furthermore, smaller cylindrical members 2 and 3 and larger cylindrical member 8 cause friction therebetween, which consumes the energy of the membrane vibration and thus reduces or prevents the membrane vibration. As the membrane vibration of the outer cylinder can be reduced or prevented, the radiating noise generated from the outer cylinder can be reduced or prevented.

While in the first embodiment the first and second smaller cylindrical members 2 and 3 are substantially identical in geometry, they may be different in geometry.

Second Embodiment

Figure 4:
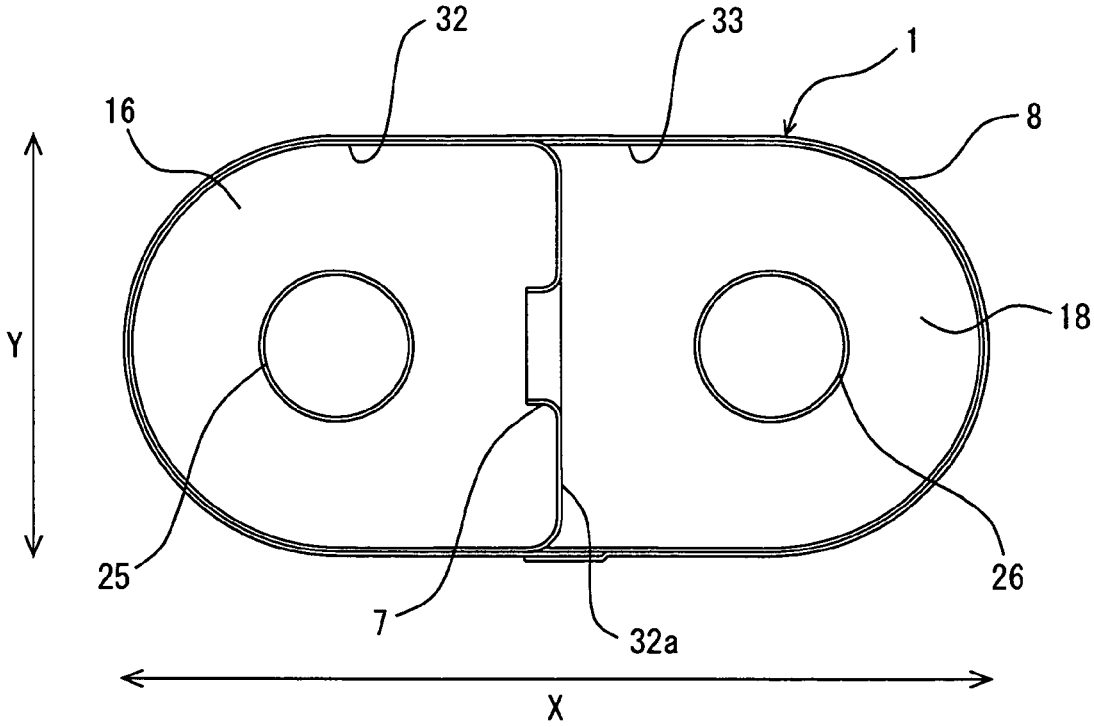
FIGS. 4 and 5 show silencers in second and third embodiments, respectively, of the present invention in a cross section corresponding to FIG. 2 and seen in a direction at a right angle to the axis.

FIG. 4 shows a second embodiment of the present invention.

While in the first embodiment the first and second smaller cylindrical members 2 and 3, i.e., two smaller cylindrical members are provided, only a single smaller cylindrical member 32 as shown in FIG. 4 may be used to configure a silencer.

Smaller cylindrical member 32 has a structure similar to that of the first smaller cylindrical member 2 described in the first embodiment and has a planar portion 32*a* similar to planar portion 2*a*. Larger cylindrical member 8 similar to that of the first embodiment is arranged to substantially closely contact the outer circumferential surface of smaller cylindrical member 32 excluding planar portion 32*a*. Along an inner circumferential surface of larger cylindrical member 8 that the outer surface of smaller cylindrical member 32 does not contact, a shell member 33 in the form of a plate is curved and thus arranged to substantially closely contact the inner circumferential surface of larger cylindrical member 8.

Shell member 33 may or may not have a circumferential end bonded to smaller cylindrical member 32, although preferably shell member 33 has the circumferential end bonded to smaller cylindrical member 32.

Similarly as described in the first embodiment, planar portion 32*a* traverses major axis X of larger cylindrical member 8 and is substantially parallel to minor axis Y of larger cylindrical member 8.

The remainder in structure is similar to that described in the first embodiment. Accordingly, similar members are denoted by reference characters similar to those in the first embodiment and will not be described repeatedly.

The second embodiment can also achieve an effect similar to that of the first embodiment.

Third Embodiment

Figure 5:
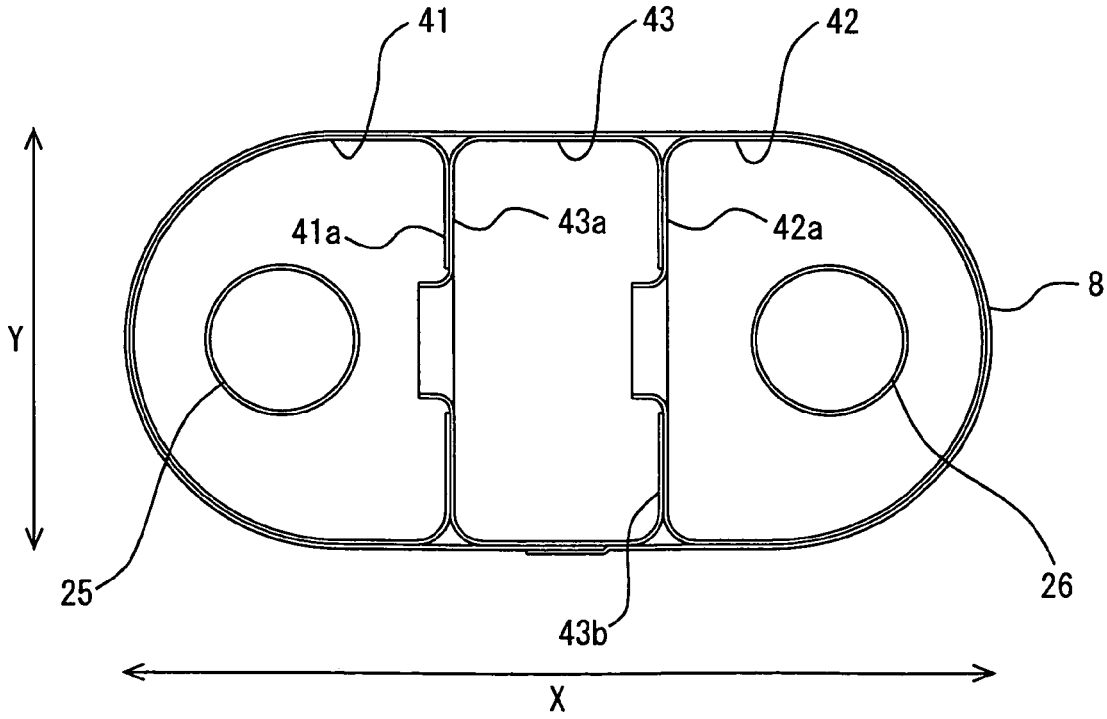

FIG. 5 shows a third embodiment of the present invention.

While in the first embodiment the first and second smaller cylindrical members 2 and 3, i.e., two smaller cylindrical members are provided, first, second and third smaller cylindrical members 41, 42 and 43, i.e., three smaller cylindrical members may be provided as shown in FIG. 5.

The first and second smaller cylindrical members 41 and 42 are formed to be similar to the first and second smaller cylindrical members 2 and 3 of the first embodiment; they are formed in the form of the letter D as seen in cross section and have planar portions 41*a* and 42*a* similar to planar portions 2*a* and 3*a*. The third smaller cylindrical member 43 is arranged between the first and second smaller cylindrical members 41 and 42 and has planar portions 43*a* and 43*b* at opposite side surfaces facing the first and second smaller cylindrical members 41 and 42.

The first and second smaller cylindrical members 41 and 42 have their respective planar portions 41*a* and 42*a* opposite each other with the third smaller cylindrical member 43 posed therebetween and one planar portion substantially closely contacts another planer portion. Each planar portion 41*a*, 42*a*, 43, 43*b* closely contacting another traverses major axis X of larger cylindrical member 8 and are also parallel to minor axis Y of larger cylindrical member 8.

Inlet pipe 25 similar to that described in the first embodiment is arranged in the first smaller cylindrical member 41 and outlet pipe 26 similar to that described in the first embodiment is arranged in the second smaller cylindrical member 42.

The remainder in structure is similar to that described in the first embodiment. Accordingly, the members similar to those of the first embodiment are similarly denoted and will not be described repeatedly.

The third embodiment can also achieve an effect to similar to those of the first and second embodiments.

Other Embodiments

While in the first to third embodiments the silencer as seen in a direction orthogonal to its axis provides a cross section in the form of an oblong circle, the cross section is only required to be oblate, and other than the oblong circle, the cross section can be set as desired, such as an ellipse, a rectangle, or the like.

Furthermore, while as described in the first to third embodiments, larger cylindrical member 8 has major and minor axes X and Y orthogonal to each other, other cylindrical member 8 may not have has major and minor axes X and Y orthogonal to each other.

It should be noted that the present invention has been described as being applicable to vehicular or similar internal combustion engines, the present invention is also applicable to silencers of any types of exhaust gas generation devices of general-purpose engines, stationary combustion devices, and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A silencer comprising:

a first smaller cylindrical member having a first planar portion in the form of a first wall, said first wall having a first planar side and a second planar side;

a second smaller cylindrical member having a second planar portion in the form of a second wall, said second wall including a third planar side and a fourth planar side;

a larger cylindrical member arranged in close contact with at least a portion of an outer peripheral surface of at least one of said first and second smaller cylindrical members;

wherein said larger cylindrical member as seen in a direction orthogonal to an axis thereof provides an oblate cross section having a major axis and a minor axis;

wherein said first and second smaller cylindrical members are arranged to have each of said first and second planar portions traversing said major axis of said larger cylindrical member; and wherein said first wall of said first smaller cylindrical member is in substantially close contact with said second wall of said second smaller cylindrical member, with one of said first and second planar sides of said first wall facing toward and in substantially close contact with one of said third and fourth planar sides of said second wall.

2. The silencer according to claim 1, wherein said first and second walls of said first and second smaller cylindrical members are each substantially parallel to said minor axis of said larger cylindrical member.

3. The silencer according to claim 1, wherein each of said first and second walls extends along at least a majority of the length of said larger cylindrical member in a direction perpendicular to both the major axis and the minor axis, and wherein said first and second walls are in contact with each other, with one of said first and second planar sides in contact with one of said third and fourth planar sides.

4. The silencer of claim 3, wherein the first planar portion includes a first through hole and a first burred hole, and wherein the second planar portion includes a second through hole and a second burred hole, and wherein said first burred hole projects to extend through said second through hole, and further wherein said second burred hole projects to extend through said first through hole.

5. A silencer comprising:

a smaller cylindrical member having a planar portion;

a larger cylindrical member arranged in close contact with at least a portion of an outer peripheral surface of said smaller cylindrical member;

wherein said larger cylindrical member includes a cylinder axis extending in a direction of a length of said larger cylindrical member, and wherein, in a cross section orthogonal to said cylinder axis, said larger cylindrical member includes an oblate cross section having a major axis and a minor axis, with said length and said cylinder axis extending orthogonal to said major axis and orthogonal to said minor axis; and wherein said smaller cylindrical member is arranged to have said planar portion traversing said major axis of said larger cylindrical member, and wherein said planar portion has a length in the direction of the cylinder axis which extends along at least a majority of said length of said larger cylindrical member, wherein said length of said planar portion is larger than a dimension of the planar portion in a direction of the minor axis, and further wherein said planar portion includes at least one through hole extending therethrough to provide communication between a region inside of said smaller cylindrical member and a region outside of said smaller cylindrical member.

6. The silencer according to claim 5, wherein first and second smaller cylindrical members are provided each having planar portions, in the form of first and second walls, respectively, said first wall having first and second sides, and said second wall having third and fourth sides, and wherein one of said first and second sides faces toward and is in substantially close contact with one of said third and fourth sides.

7. The silencer according to claim 5, wherein said smaller cylindrical member is arranged to have said planar portion substantially parallel to said minor axis of said larger cylindrical member.

8. The silencer according to claim 7, wherein first and second smaller cylindrical members are provided each having planar portions, in the form of first and second walls, respectively, said first wall having first and second sides, and said second wall having third and fourth sides, and wherein one of said first and second sides faces toward and is in substantially close contact with one of said third and fourth sides.

9. The silencer according to claim 5, wherein a plurality of smaller cylindrical members are provided, each having a planar wall having a length in the direction of the cylinder axis which extends along at least a majority of the length of said larger cylindrical member.

10. The silencer of claim 9, wherein two of said planar walls are in contact with each other, with a planar side of one wall contacting a planar side of another wall.

11. The silencer of claim 9, wherein the plurality of smaller cylindrical members includes a first smaller cylindrical member having a first planar wall including a first through hole and a first burred hole, and wherein the plurality of smaller cylindrical members further includes a second smaller cylindrical member having a second planar wall including a second through hole and a second burred hole, and wherein said first burred hole projects to extend through said second through hole, and further wherein said second burred hole projects to extend through said first through hole.

12. The silencer according to claim 5, wherein the planar portion includes a plurality of through holes extending therethrough.

13. The silencer according to claim 12, wherein the plurality of through holes includes at least a first through hole through which gases pass from inside said smaller cylindrical member to outside of said smaller cylindrical member and a second through hole through which gases pass from outside of said smaller cylindrical member to inside of said smaller cylindrical member.

14. A silencer according to claim 5, wherein the smaller cylindrical member is a first smaller cylindrical member and the planar portion is a first planar wall, and wherein the silencer further includes a second smaller cylindrical member including a second planar wall extending adjacent to the first planar wall along at least a majority of the length of the larger cylindrical member;

wherein the at least one through hole of the first planar portion includes a first hole and a second hole extending through the first planar wall;

wherein the second planar wall includes a third hole adjacent and aligned with said first hole so that gases flow from said first smaller cylindrical member into said second smaller cylindrical member through said first and third holes; and wherein said second planar wall further includes a fourth hole adjacent and aligned with said second hole so that gases flow from said second smaller cylindrical member into said first smaller cylindrical member through said second and fourth holes.

15. A silencer according to claim 14, wherein said first planar wall is in contact with said second planar wall and wherein gases flow directly from said first smaller cylindrical member into said second smaller cylindrical member through said first and third holes, and wherein gasses flow directly from said second smaller cylindrical member into said first smaller cylindrical member through said second and fourth holes.

16. A silencer comprising:

a smaller cylindrical member having a planar portion;

a larger cylindrical member arranged in close contact with at least a portion of an outer peripheral surface of said smaller cylindrical member;

wherein said larger cylindrical member includes an axis extending in a direction of a length of said larger cylindrical member, and wherein as seen in a direction orthogonal to said axis said larger cylindrical member includes an oblate cross section having a major axis and a minor axis;

wherein said smaller cylindrical member is arranged to have said planar portion traversing said major axis of said larger cylindrical member, and wherein said planar portion extends along at least a majority of said length of said larger cylindrical member, and further wherein said planar portion includes at least one through hole extending therethrough to provide communication between a region inside of said smaller cylindrical member and a region outside of said smaller cylindrical member; and wherein said planar portion of said smaller cylindrical portion is a first planar portion, and wherein said silencer further includes a second planar portion extending adjacent said first planar portion, wherein said first planar portion includes a first through hole and a first burred hole, and wherein said second planar portion includes a second through hole and a second burred hole, and wherein said first burred hole projects to extend through said second through hole, and further wherein said second burred hole projects to extend through said first through hole.

17. A silencer comprising:

a smaller cylindrical member having a planar portion;

a larger cylindrical member arranged in close contact with at least a portion of an outer peripheral surface of said smaller cylindrical member;

wherein said larger cylindrical member includes an axis extending in a direction of a length of said larger cylindrical member, and wherein as seen in a direction orthogonal to said axis said larger cylindrical member includes an oblate cross section having a major axis and a minor axis;

wherein said smaller cylindrical member is arranged to have said planar portion traversing said major axis of said larger cylindrical member, and wherein said planar portion extends along at least a majority of said length of said larger cylindrical member, and further wherein said planar portion includes at least one through hole extending therethrough to provide communication between a region inside of said smaller cylindrical member and a region outside of said smaller cylindrical member;

wherein the smaller cylindrical member is a first smaller cylindrical member and the planar portion is a first planar portion, and wherein the silencer further includes a second smaller cylindrical member including a second planar portion extending adjacent to the first planar portion along at least a majority of the length of the larger cylindrical member;

wherein the at least one through hole of the first planar portion includes a first hole and a second hole;

wherein the second planar portion includes a third hole adjacent and aligned with said first hole so that gases flow from said first smaller cylindrical member into said second smaller cylindrical member through said first and third holes;

wherein said second planar portion further includes a fourth hole adjacent and aligned with said second hole so that gases flow from said second smaller cylindrical member into said first smaller cylindrical member through said second and fourth holes; and wherein at least one of said first, second, third and fourth holes includes a burred hole which extends through the respective hole with which said burred hole is aligned.

* * * * *